US009454110B2

(12) United States Patent
Mizumoto et al.

(10) Patent No.: US 9,454,110 B2
(45) Date of Patent: Sep. 27, 2016

(54) TRANSFER MEMBER

(75) Inventors: Yoshihisa Mizumoto, Kobe (JP); Naoyuki Satoyoshi, Kobe (JP); Kiyotaka Okuda, Kobe (JP); Masafumi Yamamoto, Kobe (JP)

(73) Assignee: SUMITOMO RUBBER INDUSTRIES, LTD., Kobe-shi (JP)

( * ) Notice: Subject to any disclaimer, the term of this patent is extended or adjusted under 35 U.S.C. 154(b) by 975 days.

(21) Appl. No.: 13/276,006

(22) Filed: Oct. 18, 2011

(65) Prior Publication Data

US 2012/0129667 A1 May 24, 2012

(30) Foreign Application Priority Data

Nov. 18, 2010 (JP) ..... 2010-258085

(51) Int. Cl.
*G03G 15/16* (2006.01)

(52) U.S. Cl.
CPC .. *G03G 15/1685* (2013.01); *G03G 2215/1614* (2013.01)

(58) Field of Classification Search
CPC ..... G03G 15/1685; G03G 2215/1614
USPC ..... 399/313; 492/18
See application file for complete search history.

(56) References Cited

U.S. PATENT DOCUMENTS 3,419,639 A * 12/1968 Gentile ..... 524/255
5,978,639 A * 11/1999 Masuda et al. ..... 399/302
6,078,778 A 6/2000 Murata et al.
2004/0147383 A1* 7/2004 Uesaka ..... G03G 15/0233 492/56
2008/0057289 A1* 3/2008 Ichikawa ..... 428/304.4
2008/0159791 A1* 7/2008 Urano et al. ..... 399/313
2009/0103950 A1* 4/2009 Nakayama et al. ..... 399/252
2010/0239335 A1* 9/2010 Sawai ..... 399/319
2011/0002711 A1* 1/2011 Wada ..... 399/176

FOREIGN PATENT DOCUMENTS

JP 09-114189 A 5/1997
JP 11-084819 A 3/1999
JP 2000-336212 A 12/2000
JP 2001-140855 A 5/2001
JP 2002-053705 A 2/2002
JP 2002-278320 A 9/2002
JP 2004-323579 A 11/2004
JP 3768243 B2 2/2006
JP 2007262387 A * 10/2007
JP 2008-197267 A 8/2008
JP 2008-216462 A 9/2008
JP 2009-198768 A 9/2009
JP 2010-008440 A 1/2010

* cited by examiner

*Primary Examiner* — Jacob Cigna

(74) *Attorney, Agent, or Firm* — Birch, Stewart, Kolasch & Birch, LLP

(57) ABSTRACT

The transfer member according to the present invention is a transfer member employed for transferring toner in an image forming apparatus utilizing electrophotography, made of a rubber composition at least containing styrene-butadiene rubber, ethylene-propylene-diene rubber and epichlorohydrin rubber as rubber components.

7 Claims, 1 Drawing Sheet

TRANSFER MEMBER

BACKGROUND OF THE INVENTION

1. Field of the Invention

The present invention relates to a transfer member employed for transferring toner in an image forming apparatus such as a laser printer utilizing electrophotography, for example.

2. Description of Related Art

In an image forming apparatus such as a laser printer, an electrostatic copier, a plain paper facsimile or a composite machine thereof utilizing electrophotography, an image is formed on the surface of a paper (including a plastic film such as an OHP film: this also applies to the following description) generally through the following steps:

First, a photosensitive body having photoconductivity is prepared, and the surface of the photosensitive body is exposed in a uniformly charged state. Thus, an electrostatic latent image corresponding to the image to be formed is formed on the surface of the photosensitive body (charging step→exposing step).

Then, toner consisting of fine coloring particles is brought into contact with the surface of the photosensitive body in a state previously charged to a prescribed potential. Thus, the toner is selectively adhered to the surface of the photosensitive body in response to the potential pattern of the electrostatic latent image, which in turn is developed into a toner image (developing step).

Then, the toner image is transferred to the surface of the paper (transfer step) and further fixed (fixing step), thereby forming the image on the surface of the paper.

In the transfer step, the toner image formed on the surface of the photosensitive body may not only be directly transferred to the surface of the paper, but may also be temporarily transferred to the surface of an image carrier (primary transfer step) and thereafter retransferred to the surface of the paper (secondary transfer step).

In order to transfer the toner image from the surface of the photosensitive body to the surface of the paper in the transfer step, from the surface of the photosensitive body to the surface of the image carrier in the primary transfer step or from the surface of the image carrier to the surface of the paper in the secondary transfer step, a transfer member such as a transfer roller including a cylindrical roller body made of a semiconductive rubber composition is widely employed.

In order to transfer the toner image from the surface of the photosensitive body to the surface of the paper with the transfer roller in the transfer step, for example, the paper is passed through the space between the photosensitive body and the transfer roller brought into pressure contact with each other with prescribed force, while a prescribed transfer voltage is applied therebetween. Thus, the toner image formed on the surface of the photosensitive body is transferred to the surface of the paper.

A transfer roller including a roller body formed by blending an electronically conductive filler such as conductive carbon black or an ion-conductive polymer such as epichlorohydrin rubber into crosslinkable rubber and kneading the materials for preparing a rubber composition, cylindrically extrusion-molding the rubber composition and thereafter crosslinking the same, for example, is widely employed as the transfer roller.

A transfer roller including a roller body brought into a porous structure by introducing a foaming agent into the rubber composition and foaming the foaming agent before or simultaneously with crosslinking of the rubber composition is also widely employed.

The roller body may have a single-layer structure consisting of the rubber composition, or a multilayer structure obtained by stacking another layer on the outer periphery or the inner periphery of a layer made of the rubber composition.

For example, Patent Document 1 (Japanese Unexamined Patent Publication No. 9-114189 (1997)) describes a technique of employing a roller including a roller body having a multilayer structure obtained by stacking an outer layer made of a rubber composition made of mixed rubber of acrylonitrile-butadiene rubber (NBR) and SBR and containing conductive carbon black or perchlorate on the outer periphery of an inner layer made of a rubber composition prepared by blending conductive carbon black into NBR, ethylene-propylene-diene rubber (EPDM) or silicone rubber as a transfer roller.

Patent Document 2 (Japanese Unexamined Patent Publication No. 2002-278320) describes a technique of employing a roller including a roller body having a multilayer structure obtained by stacking an outer layer made of a fluoric material or the like on the outer periphery of an inner layer made of a rubber composition prepared by blending conductive carbon black into a mixture of EPDM, NBR and SBR as a transfer roller for a secondary transfer step.

Patent Document 3 (Japanese Unexamined Patent Publication No. 2009-198768) describes a transfer roller including a roller body made of a rubber composition prepared by blending at least one material selected from a group consisting of NBR, SBR and butadiene rubber (BR) and epichlorohydrin rubber.

SUMMARY OF THE INVENTION

In recent years, a roller made of the utmost universal material, having the simplest possible structure and manufacturable at a low cost has been required as a transfer roller employed for a universal laser printer headed for developing countries, in particular.

It is important to render a transfer roller manufacturable with a universally applicable material, in a simple structure and at a low cost, in order to spread a laser printer or the like in developing countries or the like, propel and promote following office automation, factory automation and the like, attain technicalization of developing countries and finally ease/solve the so-called North-South problems.

In order to satisfy the aforementioned requirements, various studies have been conducted as to the material for and the structure of the transfer roller.

Comparing the electronically conductive filler such as the conductive carbon black and the ion-conductive polymer such as the epichlorohydrin rubber which are components for providing semiconductivity to the transfer roller with each other, for example, it is difficult to provide uniform and stable semiconductivity to the roller body with the electronically conductive filler.

In order to stabilize the semiconductivity of the roller body, the roller body must be brought into a multilayer structure by covering the outer periphery of the roller body (the inner layer) containing the electronically conductive filler with an arbitrary outer layer, as described in each of Patent Documents 1 and 2.

If the roller body is brought into the multilayer structure, however, the manufacturing steps for the transfer roller are complicated such that the number of the steps is increased and the thicknesses of the inner and outer layers must be strictly controlled, and the productivity as well as the manufacturing yield of the transfer roller are reduced. Consequently, the cost for the transfer roller is disadvantageously increased.

On the other hand, the ion-conductive polymer can provide more uniform and stable semiconductivity to the roller body as compared with the electronically conductive filler. Therefore, the roller body can be brought into a single-layer structure to be simplified in structure, and the productivity as well as the manufacturing yield of the transfer roller can be improved by simplifying the manufacturing steps therefor, to reduce the cost for the transfer roller.

In general, NBR has been employed as the rubber forming the roller body having the single-layer structure along with the ion-conductive polymer. As the rubber forming the transfer roller employed for the universal laser printer or the like, however, it is conceivably desirable to employ SBR having higher universality and requiring a lower cost as compared with NBR.

Further, the SBR exhibits lower electric resistance as compared with the NBR, whereby an environment-friendly transfer roller can be formed with the SBR at a lower cost by reducing the compounding ratio of epichlorohydrin rubber necessary for forming a transfer roller exhibiting the same roller resistance.

According to studies conducted by the inventors, however, a roller body made of a rubber composition prepared by blending the SBR and the epichlorohydrin rubber is insufficient in resistance (may hereinafter be referred to as "ozone resistance") against ozone generated in the printer or the like.

The roller body is rapidly ozone-degraded when repetitively used for image formation, and hence the roller resistance of the transfer roller remarkably fluctuates in a relatively short period, or the roller body easily causes ozone cracking as the case may be.

If the transfer roller must be frequently exchanged due to such a problem caused in a short period, the advantages resulting from the employment of the universally applicable SBR are lost.

An object of the present invention is to provide a transfer member such as a transfer roller made of a rubber composition containing universally applicable SBR, allowing the utmost simplification of the structure and exhibiting excellent ozone resistance.

In order to sole the aforementioned problems, the inventors have studied a technique of improving ozone resistance in the whole of a transfer member by blending a third component having excellent ozone resistance into a system combinedly prepared from SBR and epichlorohydrin rubber.

As a result, the inventors have found that the ozone resistance of the transfer member can be remarkably improved beyond their expectations when EPDM is blended as the third component, since the EPDM is not only excellent in ozone resistance itself but also suppresses ozone degradation of the SBR.

In other words, the transfer member according to the present invention is made of a rubber composition at least containing styrene-butadiene rubber (SBR), ethylene-propylene-diene rubber (EPDM) and epichlorohydrin rubber as rubber components.

When the transfer member is brought into a foaming structure, the quantity of the rubber composition necessary for forming the transfer member having the same volume can be reduced, whereby the transfer member can be reduced in weight, and the cost therefor can be more reduced.

When the transfer member is applied to a transfer roller, for example, energy necessary for rotation can also be reduced due to the weight reduction. Further, a roller body can be improved in flexibility to be prevented from scratching the surface of a photosensitive body when the roller body is brought into pressure contact with the photosensitive body, or a large nip width can be ensured for the roller body brought into pressure contact with the photosensitive body for improving transfer efficiency of a toner image.

Therefore, the transfer member according to the present invention is preferably made of a rubber composition further containing a foaming agent, and has a porous structure resulting from foaming of the foaming agent.

The EPDM exhibits higher electric resistance as compared with the SBR and has an SP (solubility parameter) value remarkably different from that of the SBR, and hence the same is not easy to knead.

Therefore, the compounding ratio of the EPDM is preferably minimized in a range ensuring sufficient ozone resistance of the transfer member, and particularly preferably less than the total compounding ratio of the SBR and the epichlorohydrin rubber.

In other words, the rubber composition forming the transfer member according to the present invention preferably contains SBR (S), EPDM (E) and epichlorohydrin rubber (C) in a range satisfying the following formula (1) in mass ratio:

$$S+C>E \quad (1)$$

In order to take advantage of the effects of the SBR having high universal applicability, requiring a low cost and exhibiting low electric resistance, the rubber composition preferably contains only the SBR, the EPDM and the epichlorohydrin rubber as the rubber components.

When polar rubber such as NBR, chloroprene rubber (CR), butadiene rubber (BR) or acrylic rubber (ACM), for example, is blended into the rubber composition, however, the roller resistance of the transfer roller can be finely adjusted, for example. The compounding ratio of the polar rubber is preferably less than the compounding ratio of the SBR, in order not to hinder the aforementioned effects of the SBR.

In other words, the rubber composition forming the transfer member according to the present invention preferably contains the polar rubber (P) with respect to the SBR (S) in a range satisfying the following formula (2) in mass ratio:

$$S>P \quad (2)$$

The polar rubber is preferably at least one material selected from a group consisting of NBR, CR, BR and ACM, as hereinabove described.

The transfer member according to the present invention can be formed in an arbitrary shape such as a flat plate shape, for example, in response to the shape, the structure or the like of an image forming apparatus into which the transfer member is built. In a case of the most general transfer roller, the transfer roller preferably includes a cylindrical roller body having a single-layer structure entirely made of the rubber composition, in order to simplify the structure to the utmost.

According to the present invention, a transfer member such as a transfer roller made of a rubber composition containing universally applicable SBR, allowing the utmost simplification of the structure and exhibiting excellent ozone resistance can be provided.

The foregoing and other objects, features and effects of the present invention will become more apparent from the following detailed description of the embodiments with reference to the attached drawings.

DETAILED DESCRIPTION OF PREFERRED EMBODIMENTS

Figure 1:
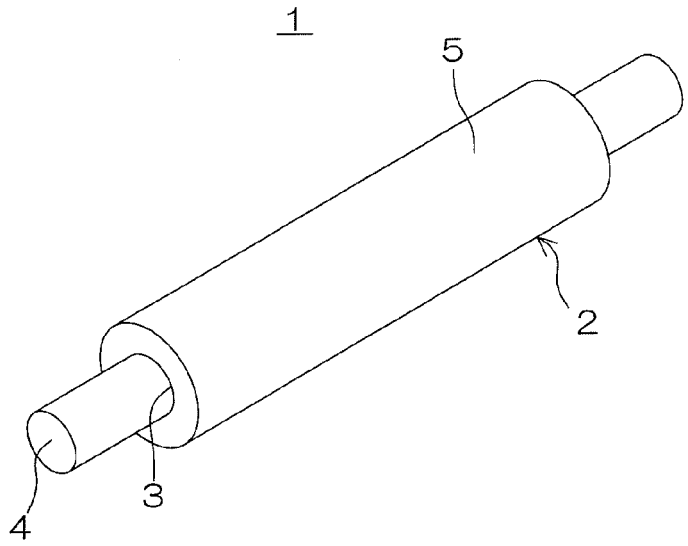
FIG. 1 is a perspective view showing the appearance of a transfer roller according to an embodiment of the present invention.

FIG. 1 is a perspective view showing the appearance of a transfer roller according to an embodiment of the present invention.

Referring to FIG. 1, a transfer roller 1 includes a cylindrical roller body 2 having a single-layer structure and a shaft 4 inserted into a through-hole 3 at the center of the roller body 2.

The shaft 4 is integrally made of a metal such as aluminum, an aluminum alloy or stainless steel, for example. The roller body 2 and the shaft 4 are electrically bonded and mechanically fixed to each other by a conductive adhesive or the like, for example, to be integrally rotated.

The roller body 2 is formed by molding a rubber composition at least containing SBR, EPDM and epichlorohydrin rubber as rubber components into the shape of the roller body 2 by extrusion molding or the like and thereafter crosslinking the rubber composition.

(SBR)

In the aforementioned rubber components, the SBR can be prepared from any SBR synthesized by copolymerizing styrene and 1,3-butadiene by emulsion polymerization, solution polymerization or the like. Further, the SBR can be prepared from either one of oil-extended SBR adjusted in flexibility by adding extender oil and non-oil-extended SBR containing no extender oil.

In addition, the SBR can be prepared from any one of high-styrene SBR, medium-styrene SBR and low-styrene SBR classified according to styrene contents. Various physical properties of the roller body 2 can be adjusted by varying the styrene content and the degree of crosslinking.

One or more of such SBR materials can be employed.

The compounding ratio of the SBR is preferably not less than 40 mass % of the total quantity of the rubber components, and preferably not more than 90 mass %.

If the compounding ratio of the SBR is less than the above range, the aforementioned effects of the SBR having high universal applicability, requiring a low cost and exhibiting low electric resistance may not be sufficiently attained.

If the compounding ratio of the SBR exceeds the above range, on the other hand, the compounding ratio of the EPDM may be so relatively reduced that no excellent ozone resistance can be provided to the roller body 2. Further, the compounding ratio of the epichlorohydrin rubber may be so relatively reduced that no excellent semiconductivity can be provided to the roller body 2.

(Epichlorohydrin Rubber)

The epichlorohydrin rubber can be prepared from one or more of a homopolymer of epichlorohydrin, a bicopolymer of epichlorohydrin and ethylene oxide, a bicopolymer of epichlorohydrin and propylene oxide, a bicopolymer of epichlorohydrin and allyl glycidyl ether, a tricopolymer of epichlorohydrin, ethylene oxide and allyl glycidyl ether, a tricopolymer of epichlorohydrin, propylene oxide and allyl glycidyl ether and a quaterpolymer of epichlorohydrin, ethylene oxide, propylene oxide and allyl glycidyl ether.

In particular, the epichlorohydrin rubber is preferably prepared from a copolymer containing ethylene oxide, and the ethylene oxide content in such a copolymer is preferably 30 to 95 mole %, more preferably 55 to 95 mole %, and particularly preferably 60 to 80 mole %.

While the ethylene oxide reduces electric resistance, the effect of reducing the electric resistance is small if the ethylene oxide content is less than the above range. If the ethylene oxide content exceeds the above range, on the other hand, the ethylene oxide is crystallized to hinder segmental motion of molecular chains, and hence the electric resistance tends to increase to the contrary. Further, the hardness of the roller body 2 may be increased after the crosslinking, or the viscosity of the rubber composition may be increased in heating/melting before the crosslinking.

The epichlorohydrin rubber is particularly preferably prepared from a bicopolymer (ECO) of epichlorohydrin and ethylene oxide.

The ethylene oxide content in the ECO is preferably 30 to 80 mole %, and particularly preferably 50 to 80 mole %. Further, the epichlorohydrin content is preferably 20 to 70 mole %, and particularly preferably 20 to 50 mole %.

The epichlorohydrin rubber can also be prepared from a tricopolymer (GECO) of epichlorohydrin, ethylene oxide and allyl glycidyl ether.

The ethylene oxide content in the GECO is preferably 30 to 95 mole %, and particularly preferably 60 to 80 mole %. Further, the epichlorohydrin content is preferably 4.5 to 65 mole %, and particularly preferably not less than 15 to 40 mole %. In addition, the allyl glycidyl ether content is preferably 0.5 to 10 mole %, and particularly preferably 2 to 6 mole %.

As the GECO, a denatured substance prepared by denaturing a bicopolymer (ECO) of epichlorohydrin and ethylene oxide with allyl glycidyl ether is also known in addition to a copolymer in a narrow sense prepared by copolymerizing the aforementioned three types of monomers, and either one of the copolymers can be employed in the present invention.

The compounding ratio of the epichlorohydrin rubber is preferably not less than 5 mass % of the total quantity of the rubber components, and preferably not more than 40 mass %.

If the compounding ratio of the epichlorohydrin rubber is less than the above range, it may not be possible to provide excellent semiconductivity to the roller body 2.

If the compounding ratio of the epichlorohydrin rubber exceeds the above range, on the other hand, the compounding ratio of the SBR may be so relatively reduced that the aforementioned effects of the SBR cannot be sufficiently attained. Further, the compounding ratio of the EPDM may also be so relatively reduced that no excellent ozone resistance can be provided to the roller body 2.

(EPDM)

The EPDM can be prepared from any EPDM obtained by adding a small quantity of a third component (a diene component) to ethylene and propylene thereby introducing double bonds into main chains. Various products of the EPDM varying with the types and the quantities of the third component are provided. The third component can be typically prepared from ethylidene norbornene (ENB), 1,4-hexadiene (1,4-HD) or dicyclopentadiene (DCP), for example. A Ziegler catalyst is generally employed as a polymerization catalyst.

The rubber composition preferably contains the SBR (S), the EPDM (E) and the epichlorohydrin rubber (C) in a range satisfying the following formula (1) in mass ratio:

$$S+C>E \quad (1)$$

If the formula (1) is not satisfied, i.e., if the compounding ratio of the EPDM is not less than the total compounding ratio of the SBR and the epichlorohydrin rubber, the compounding ratio of the SBR may be so relatively reduced that the aforementioned effects of the SBR cannot be sufficiently attained. Further, the compounding ratio of the epichlorohydrin rubber may also be so relatively reduced that no excellent semiconductivity can be provided to the roller body 2.

The compounding ratio of the EPDM is particularly preferably not less than 5 mass % of the total quantity of the rubber components, and preferably not more than 40 mass %, in the range satisfying the above formula (1).

If the compounding ratio of the EPDM is less than the above range, it may not be possible to provide excellent ozone resistance to the roller body 2.

If the compounding ratio of the EPDM exceeds the above range, on the other hand, the compounding ratio of the SBR may be so relatively reduced that the aforementioned effects of the SBR cannot be sufficiently attained. Further, the compounding ratio of the epichlorohydrin rubber may also be so relatively reduced that no excellent semiconductivity can be provided to the roller body 2.

(Polar Rubber)

When polar rubber is blended into the rubber composition, the roller resistance of the roller body 2 can be finely adjusted as described above. The polar rubber can be prepared from one or more of NBR, CR, BR and ACM, for example.

The polar rubber is particularly preferably prepared from NBR. The NBR can be prepared from any one of low-nitrile NBR, medium-nitrile NBR, medium-high-nitrile NBR, high-nitrile NBR and extra-high-nitrile NBR classified according to acrylonitrile contents.

The rubber composition preferably contains the polar rubber (P) with respect to the SBR (S) in a range satisfying the following formula (2) in mass ratio:

$$S>P \quad (2)$$

If the formula (2) is not satisfied, i.e., if the compounding ratio of the polar rubber is not less than the compounding ratio of the SBR, the compounding ratio of the SBR may be so relatively reduced that the aforementioned effects of the SBR cannot be sufficiently attained.

The compounding ratio of the polar rubber, which can be arbitrarily set in response to the target roller resistance of the roller body 2 in the range satisfying the above formula (1), is particularly preferably not less than 5 mass % of the total quantity of the rubber components, and preferably not more than 40 mass %.

If the compounding ratio of the polar rubber is less than the above range, it may not be possible to attain the effect of finely adjusting the roller resistance of the roller body 2.

If the compounding ratio of the polar rubber exceeds the above range, on the other hand, the compounding ratio of the SBR may be so relatively reduced that the aforementioned effects of the SBR cannot be sufficiently attained. Further, the compounding ratio of the EPDM may also be so relatively reduced that no excellent ozone resistance can be provided to the roller body 2. In addition, the compounding ratio of the epichlorohydrin rubber may be so relatively reduced that no excellent semiconductivity can be provided to the roller body 2.

(Foaming Agent)

As hereinabove described, a foaming agent may be introduced into the rubber composition for bringing the roller body 2 into a porous structure by foaming the foaming agent before or simultaneously with the crosslinking of the rubber composition.

The foaming agent can be prepared from any foaming agent capable of foaming the rubber composition by generating gas by heating.

Such a foaming agent can be prepared from one or more of azodicarbonamide ($H_2NOCN{=}NCONH_2$, ADCA), 4,4'-oxybis(benzene sulfonyl hydrazide) (OBSH) and N,N-dinitrosopentamethylene tetramine (DPT), for example.

The compounding ratio of the foaming agent, which can be arbitrarily set in response to the expansion ratio or the like of the roller body 2, is preferably not less than 1 part by mass, more preferably not less than 2 parts by mass, and particularly preferably not less than 4 parts by mass with respect to 100 parts by mass of the total quantity of the rubber components, and preferably not more than 12 parts by mass, more preferably not more than 10 parts by mass, and particularly preferably not more than 8 parts by mass.

A foaming assistant can also be employed. The foaming assistant can be prepared from any foaming assistant having a function of assisting the rubber composition in foaming by reducing the foaming starting temperature of the foaming agent and prompting thermal decomposition while not generating any gas itself.

When the foaming agent is prepared from ADCA, for example, the foaming assistant is preferably prepared from urea ($H_2NCONH_2$) capable of reducing the foaming starting temperature of the ADCA.

The compounding ratio of the foaming assistant, which can be arbitrarily set in response to the type or the like of the employed foaming agent, is preferably not less than 1 part by mass, and particularly preferably not less than 2 parts by mass with respect to 100 parts by mass of the total quantity of the rubber components, and preferably not more than 12 parts by mass, and particularly preferably not more than 10 parts by mass.

The roller body 2 can be brought into the porous structure by a method other than the foaming of the foaming agent.

Examples of the other method include a method of dispersing microcapsules prepared by wrapping liquid low-boiling hydrocarbon with shells of a thermoplastic polymer into the rubber composition and thermally expanding the same by heat in the crosslinking, a method of dispersing previously thermally expanded microcapsules into the rubber composition, and a method of dispersing particles of common salt or the like into the rubber composition and eluting the particles with hot water or the like after the crosslinking.

(Crosslinking Agent, Accelerator and Supplement Accelerator)

A crosslinking agent for crosslinking the rubber components, an accelerator, a supplement accelerator and the like are blended into the rubber composition.

In the aforementioned components, the crosslinking agent can be prepared from a sulfur-based crosslinking agent, a thiourea-based crosslinking agent, a triazine derivative-based crosslinking agent, a peroxide-based crosslinking agent or any monomer, for example. Any one of the materials may be singly employed, or not less than two thereof may be employed in combination.

The sulfur-based crosslinking agent can be prepared from powdered sulfur or an organic sulfur-containing compound. The organic sulfur-containing compound can be prepared from tetramethylthiuram disulfide or N,N-dithiobis morpholine.

The thiourea-based crosslinking agent can be prepared from tetramethyl thiourea, trimethyl thiourea, ethylene thiourea or thiourea expressed as $(C_nH_{2n+1}NH)_2C{=}S$ [where n represents an integer of 1 to 10], for example.

The peroxide-based crosslinking agent can be prepared from benzoyl peroxide or the like.

The compounding ratio of the crosslinking agent is preferably not less than 0.2 parts by mass, and particularly preferably not less than 1 part by mass with respect to 100 parts by mass of the total quantity of the rubber components, and preferably not more than 5 parts by mass, and particularly preferably not more than 3 parts by mass.

The crosslinking agent is preferably combinedly prepared from sulfur and thiourea.

In this case, the compounding ratio of sulfur is preferably not less than 0.1 parts by mass, and particularly preferably not less than 0.2 parts by mass with respect to 100 parts by mass of the total quantity of the rubber components, and preferably not more than 5 parts by mass, and particularly preferably not more than 2 parts by mass.

If the compounding ratio of sulfur is less than the above range, the crosslinking rate in the whole of the rubber composition may be so reduced that the time required for the crosslinking is increased to reduce the productivity of the transfer roller 1. If the compounding ratio of sulfur exceeds the above range, on the other hand, compression set of the crosslinked roller body 2 may be increased, or excess sulfur may bloom on the outer peripheral surface of the roller body 2.

The compounding ratio of thiourea is preferably not less than 0.009 moles, and particularly preferably not less than 0.0015 moles with respect to 100 g of the total quantity of the rubber components, and preferably not more than 0.0800 moles, and particularly preferably not more than 0.0400 moles.

The compounding ratio of thiourea is so set in the above range that thiourea hardly blooms or contaminates a photosensitive body and not much hinders molecular motion of the rubber materials, whereby the roller resistance of the transfer roller 1 can be more reduced.

The roller resistance can be more reduced as the compounding ratio of thiourea is increased in the above range to increase the crosslinking density.

In other words, the compression set of the roller body 2 is hard to improve and the roller resistance cannot be sufficiently reduced, if the compounding ratio of thiourea is less than 0.0009 moles with respect to 100 g of the total quantity of the rubber components. If the compounding ratio of thiourea exceeds 0.0800 moles, on the other hand, the thiourea blooms or contaminates the photosensitive body, or easily reduces mechanical properties such as elongation at break.

The accelerator and the supplement accelerator may be further blended, in response to the type of the crosslinking agent.

The accelerator can be prepared from an inorganic accelerator such as hydrated lime, magnesia (MgO) or litharge (PbO), or an organic accelerator, for example.

The organic accelerator can be prepared from one or more of a guanidine-based accelerator such as di-o-tolylguanidine, 1,3-diphenyl guanidine, 1-o-tolylbiguanide or di-o-tolylguanidine salt of dicatechol borate; a thiazole-based accelerator such as 2-mercaptobenzothiazole or dibenzothiazyl disulfide; a sulfenamide-based accelerator such as N-cyclohexyl-2-benzothiazyl sulfenamide; a thiuram-based accelerator such as tetramethylthiuram monosulfide, tetramethylthiuram disulfide, tetraethylthiuram disulfide or dipentamethylenethiuram tetrasulfide; and a thiourea-based accelerator, for example.

The compounding ratio of the accelerator is preferably not less than 0.1 parts by mass, and particularly preferably not less than 0.5 parts by mass with respect to 100 parts by mass of the total quantity of the rubber components, and preferably not more than 5 parts by mass, and particularly preferably not more than 2 parts by mass.

The supplement accelerator can be prepared from one or more of a metallic compound such as zinc white; fatty acid such as stearic acid, oleic acid or cottonseed-oil fatty acid; and other well-known supplement accelerators.

The compounding ratio of the supplement assistant is preferably not less than 0.1 parts by mass, and particularly preferably not less than 0.5 parts by mass with respect to 100 parts by mass of the total quantity of the rubber components.

(Others)

Various types of additives may further be blended into the rubber composition as necessary. The additives include an acid acceptor, a plasticizing component (a plasticizer, a process aid or the like), an antidegradant, a filler, an anti-scorching agent, an ultraviolet absorber, a lubricant, a pigment, an antistatic agent, a flame retardant, a neutralizer, a nucleator, an antifoaming agent, a co-crosslinking agent and the like, for example.

In the aforementioned additives, the acid acceptor prevents chlorine-based gas generated from the epichlorohydrin rubber in the crosslinking of the rubber components from remaining in the roller body 2, hindering the crosslinking and contaminating the photosensitive body.

The acid acceptor, which can be prepared from any substance acting as an acid receptor, is preferably prepared from hydrotalcite or Magsarat excellent in dispersibility, and particularly preferably prepared from hydrotalcite.

A higher acid accepting effect can be attained by employing the hydrotalcite along with magnesium oxide or potassium oxide, for more reliably preventing the photosensitive body from contamination.

The compounding ratio of the acid acceptor is preferably not less than 0.2 parts by mass, and particularly preferably not less than 1 part by mass with respect to 100 parts by mass of the total quantity of the rubber components, and preferably not more than 10 parts by mass, and particularly preferably not more than 5 parts by mass.

If the compounding ratio of the acid acceptor is less than the above range, the effects of the acid acceptor may not be sufficiently attained. If the compounding ratio of the acid acceptor exceeds the above range, on the other hand, the hardness of the crosslinked roller body 2 may be increased.

The plasticizer can be prepared from any plasticizer such as dibutyl phthalate (DBP), dioctyl phthalate (DOP) or tricresyl phosphate, or wax, for example.

The process aid can be prepared from fatty acid such as stearic acid.

The compounding ratio of such a plasticizing component is preferably not more than 5 parts by mass with respect to 100 parts by mass of the total quantity of the rubber components. Thus, the plasticizing component can be prevented from causing bleeding when an oxide film is formed on an outer peripheral surface 5 of the roller body 1 as necessary or from contaminating the photosensitive body when the transfer roller 1 is mounted on an image forming apparatus or the image forming apparatus is driven, for example. In consideration of the object, the plasticizing component is particularly preferably prepared from polar wax.

The antidegradant can be prepared from any age resistor or any antioxidant.

The antioxidant reduces environment dependency of the roller resistance of the transfer roller 1, and suppresses increase in the roller resistance in continuous conduction. The antioxidant can be prepared from nickel diethyldithiocarbamate [Nocrack (registered trademark) NEC-P by Ouchi Shinko Chemical Industrial] or nickel dibutyldithiocarbamate [Nocrack NBC by Ouchi Shinko Chemical Industrial], for example.

When the oxide film is formed on the outer peripheral surface 5 of the roller body 2 and the antioxidant is blended into the rubber composition, the compounding ratio of the antioxidant is preferably so properly set that the formation of the oxide film efficiently proceeds.

The filer can be prepared from one or more of zinc oxide, silica, carbon, carbon black, clay, talc, calcium carbonate, magnesium carbonate, aluminum hydroxide and the like, for example.

The mechanical strength etc. of the roller body 2 can be improved by blending the filler into the rubber composition.

Electronic conductivity can also be provided to the roller body 2 by employing conductive carbon black as the filler.

The compounding ratio of the filler is preferably not more than 100 parts by mass, and particularly preferably not more than 80 parts by mass with respect to 100 parts by mass of the total quantity of the rubber components.

The antiscorching agent can be prepared from one or more of N-cyclohexyl thiophthalimide, phthalic anhydride, N-nitrosodiphenylamine, 2,4-diphenyl-4-methyl-1-pentene and the like, for example. The antiscorching agent is particularly preferably prepared from N-cyclohexyl thiophthalimide.

The compounding ratio of the antiscorching agent is preferably not less than 0.1 parts by mass with respect to 100 parts by mass of the total quantity of the rubber components, and preferably not more than 5 parts by mass, and particularly preferably not more than 1 part by mass.

The co-crosslinking agent denotes a component crosslinking itself and also crosslinking with the rubber components for polymerizing the overall rubber composition.

The co-crosslinking agent can be prepared from one or more of an ethylenic unsaturated monomer represented by ester methacrylate or metal salt of methacrylic acid or acrylic acid, a multifunctional polymer utilizing a functional group of 1,2-polybutadiene, dioxime and the like, for example.

The ethylenic unsaturated monomer can be prepared from one or more of:

(a) monocarboxylic acid such as acrylic acid, methacrylic acid or crotonic acid, (b) dicarboxylic acid such as maleic acid, fumaric acid or itaconic acid, (c) ester or anhydride of unsaturated carboxylic acid (a) or (b), (d) metal salt of any one of (a) to (c), (e) aliphatic conjugated diene such as 1,3-butadiene, isoprene or 2-chlor-1,3-butadiene, (f) aromatic vinyl compound such as styrene, α-methylstyrene, vinyl toluene, ethylvinyl benzene or divinyl benzene, (g) vinyl compound such as triallyl isocyanurate, triallyl cyanurate or vinyl pyridine having a heterocyclic ring, and (h) vinyl cyanide compound such as (meth)acrylonitrile or α-acrylonitrile, acrolein, formyl sterol, vinyl methyl ketone, vinyl ethyl ketone or vinyl butyl ketone, for example.

The ester (c) of the unsaturated carboxylic acid is preferably prepared from ester of monocarboxylic acid.

The ester of the monocarboxylic acid can be prepared from one or more of:

alkyl ester of (meth)acrylic acid such as methyl (meth) acrylate, ethyl (meth)acrylate, n-propyl (meth)acrylate, i-propyl (meth)acrylate, n-butyl (meth)acrylate, i-butyl (meth)acrylate, n-pentyl (meth)acrylate, i-pentyl (meth) acrylate, n-hexyl (meth)acrylate, cyclohexyl (meth)acrylate, 2-ethylhexyl (meth)acrylate, octyl (meth)acrylate, i-nonyl (meth)acrylate, tert-butylcyclohexyl (meth)acrylate, decyl (meth)acrylate, dodecyl (meth)acrylate, hydroxymethyl (meth)acrylate or hydroxyethyl (meth)acrylate;

aminoalkyl ester of (meth)acrylic acid such as aminoethyl (meth)acrylate, dimethylaminoethyl (meth)acrylate or butylaminoethyl (meth)acrylate;

(meth)acrylate having an aromatic ring such as benzyl (meth)acrylate, benzoyl (meth)acrylate or allyl (meth)acrylate;

(meth)acrylate having an epoxy group such as glycidyl (meth)acrylate, methaglycidyl (meth)acrylate or epoxycylohexyl (meth)acrylate;

(meth)acrylate having a functional group such as N-methylol (meth) acrylamide, γ-(meth)acryloxypropyl trimethoxysilane or tetrahydrofurfuryl methacrylate; and multifunctional (meth)acrylate such as ethylene glycol di(meth)acrylate, trimethylolpropane tri(meth)acrylate, ethylene dimethacrylate (EDMA), polyethylene glycol dimethacrylate or isobutylene ethylene dimethacrylate, for example.

(Roller Resistance)

In the transfer roller 1 including the roller body 2 made of the rubber composition containing the aforementioned components, the roller resistance under an applied voltage of 100 V measured in an ordinary temperature and humidity environment having a temperature of 23±1° C. and relative humidity of 55±1% is preferably not more than $10^{10}\Omega$, and particularly preferably not more than $10^{9}\Omega$.

Figure 2:
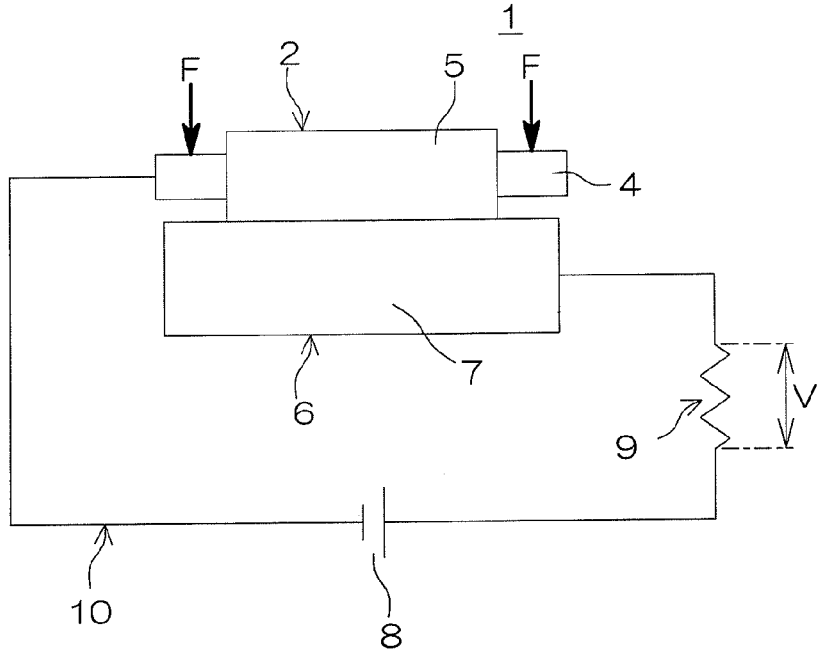
FIG. 2 is a diagram for illustrating a method of measuring roller resistance of the transfer roller shown in FIG. 1.

FIG. 2 is a diagram for illustrating a method of measuring the roller resistance of the transfer roller 1 shown in FIG. 1.

Referring to FIGS. 1 and 2, the roller resistance is expressed by a value measured by the following method in the present invention:

In order to measure the roller resistance, an aluminum drum 6 rotatable at a constant speed is first prepared, for example. Then, the outer peripheral surface 5 of the roller body 2 of the transfer roller 1 whose roller resistance is to be measured is brought into contact with an outer peripheral surface 7 of the aluminum drum 6 from above.

Then, a DC power source 8 and a resistor 9 are serially connected between the shaft 4 of the transfer roller 1 and the aluminum drum 6, thereby forming a measuring circuit 10. The minus and plus sides of the DC power source 8 are connected with the shaft 4 and the resistor 9 respectively. The resistance r of the resistor 9 is set to 100Ω.

Then, loads F of 500 g are applied to both end portions of the shaft 4, thereby bringing the roller body 2 into pressure contact with the aluminum drum 6. A detection voltage V applied to the resistor 9 when a DC voltage E of 1000 V is applied from the DC power source 8 between the shaft 4 and the aluminum drum 6 is measured in this state, while rotating the aluminum drum 6 (at a rotational frequency of 30 rpm).

From the detection voltage V and the applied voltage E (=1000 V), the roller resistance R of the transfer roller 1 is basically obtained by the following formula (i'):

$$R=r\times E/(V-r) \quad \text{(i')}$$

However, the term (−r) in the denominator of the formula (i') can be regarded as minute, and hence a value obtained by the following formula (i) is regarded as the roller resistance of the transfer roller 1 in the present invention:

$$R=r\times E/V \quad \text{(i)}$$

(Hardness Etc.)

In the case of bringing the roller body 2 into a porous structure, Asker C hardness of the roller body 2 measured according to the method defined in SRIS 0101 "physical testing method for expanded rubber", the Society of Rubber Industry, Japan, in an ordinary temperature and humidity environment having a temperature of 23±1° C. and relative humidity of 55±1% is preferably not more than 50, and particularly preferably about 35±5.

This is because the roller body 2 is so insufficient in flexibility that neither an effect of improving transfer efficiency of toner by ensuring a large nip width nor an effect of reducing damage on the photosensitive body can be attained if the Asker C hardness exceeds the above range.

The roller body 2 can be adjusted to have prescribed compression set, a prescribed dielectric loss tangent and the like. In order to adjust the compression set, the Asker C hardness, the roller resistance and the dielectric loss tangent, the types and the quantities of the components constituting the rubber composition may be adjusted, for example.

EXAMPLES

Example 1

Preparation of Rubber Composition

A rubber composition was prepared by kneading 75 parts by mass of SBR [JSR 1502 by JSR Corporation], 5 parts by mass of EPDM [Espren (registered trademark) EPDM505A by Sumitomo Chemical Co., Ltd.] and 20 parts by mass of ECO [Hydrin (registered trademark) T3108 by Nippon Zeon Co., Ltd.] as well as the components shown in Table 1 in a Banbury mixer.

TABLE 1

| Component | Part by Mass |
|---|---|
| Filler | 10 |
| Foaming Agent | 4 |
| Foaming Assistant | 2.5 |
| Acid Acceptor | 3 |
| Vulcanizing Agent | 1.5 |
| Accelerator DM | 0.5 |
| Accelerator TS | 0.5 |

The components in Table 1 are as follows:

Filler: carbon black HAF

Foaming agent: ADCA

Foaming assistant: urea

Acid acceptor: hydrotalcite

Vulcanizing agent: powdered sulfur

Accelerator DM: di-2-benzothiazolyl disulfide [Nocceler (registered trademark) DM by Ouchi Shinko Chemical Industrial]

Accelerator TS: tetramethylthiuram monosulfide [Nocceler TS by Ouchi Shinko Chemical Industrial]

(Manufacturing of Transfer Roller)

The rubber composition was fed to an extruder and extruded into a cylindrical shape having an outer diameter of 10 mm and an inner diameter of 3.0 mm, and the extrusion-molded body was cut into a prescribed length and mounted on a temporary shaft for crosslinking having an outer diameter of 2.2 mm.

Then, the extrusion-molded body was heated in a vulcanizer at 120° C. for 10 minutes and then at 160° C. for 20 minutes, for obtaining a roller body by foaming the rubber composition with gas generated by thermal decomposition of the foaming agent and crosslinking the rubber components. The outer diameter of the roller body was ϕ35 mm.

Then, the roller body was remounted on a shaft of ϕ6 mm in outer diameter having an outer peripheral surface coated with a conductive thermosetting adhesive and heated in an oven at 160° C. for 60 minutes for solidifying the thermosetting adhesive, thereby electrically bonding and mechanically fixing the roller body and the shaft to each other.

Then, both ends of the roller body were cut, and a transfer roller was manufactured by grinding the outer peripheral surface of the roller body by traverse grinding with a cylindrical grinder so that the outer diameter of the roller body was ϕ12.5 mm (tolerance: ±0.1 mm).

The Asker C hardness (with application of a load of 1 kgf) of the roller body was adjusted to be in the range of 35±5 (this also applies to the following description).

Example 2

A transfer roller was manufactured by preparing a rubber composition similarly to Example 1, except that the loadings of SBR and EPDM were set to 73 parts by mass and 7 parts by mass respectively.

Example 3

A transfer roller was manufactured by preparing a rubber composition similarly to Example 1, except that the loadings of SBR and EPDM were set to 70 parts by mass and 10 parts by mass respectively.

Example 4

A transfer roller was manufactured by preparing a rubber composition similarly to Example 1, except that the loadings of SBR and EPDM were set to 45 parts by mass and 35 parts by mass respectively.

Example 5

A transfer roller was manufactured by preparing a rubber composition similarly to Example 1, except that 20 parts by mass of NBR [JSR N250SL by JSR Corporation, low-nitrile NBR, acrylonitrile content: 20%] was added while the loadings of SBR and EPDM were set to 50 parts by mass and 10 parts by mass respectively.

Example 6

A transfer roller was manufactured by preparing a rubber composition similarly to Example 1, except that the loadings of ECO and EPDM were set to 15 parts by mass and 10 parts by mass respectively.

Example 7

A transfer roller was manufactured by preparing a rubber composition similarly to Example 1, except that the loadings of SBR, ECO and EPDM were set to 80 parts by mass, 10 parts by mass and 10 parts by mass respectively.

Comparative Example 1

A rubber composition was prepared by kneading 80 parts by mass of NBR [JSR N250SL by JSR Corporation, low-nitrile NBR, acrylonitrile content: 20%] and 20 parts by mass of ECO [Hydrin T3108 by Nippon Zeon Co., Ltd.] as well as the components shown in Table 1 in a Banbury mixer. Then, a transfer roller was manufactured similarly to Example 1, except that the rubber composition was employed.

Comparative Example 2

A rubber composition was prepared by kneading 80 parts by mass of SBR [JSR 1502 by JSR Corporation] and 20 parts by mass of ECO [HYDRIN T3108 by Nippon Zeon Co., Ltd.] as well as the components shown in Table 1 in a Banbury mixer. Then, a transfer roller was manufactured similarly to Example 1, except that the rubber composition was employed.

Comparative Example 3

A rubber composition was prepared by kneading 80 parts by mass of SBR [JSR 1502 by JSR Corporation] and 20 parts by mass of EPDM [Espren (registered trademark) EPDM505A by Sumitomo Chemical Co., Ltd.] as well as the components shown in Table 1 in a Banbury mixer. Then, a transfer roller was manufactured similarly to Example 1, except that the rubber composition was employed.

(Measurement of Roller Resistance)

Roller resistance of the transfer roller manufactured according to each of Examples 1 to 7 and comparative examples 1 to 3 under an applied voltage of 1000 V was measured by the aforementioned method in an ordinary temperature and humidity environment having a temperature of 23±1° C. and relative humidity of 55±1%. The roller resistance was evaluated as excellent when the measured value was not more than $10^{10}\Omega$, and evaluated as defective when the measured value exceeded $10^{10}\Omega$. Table 2 shows the roller resistance in log R.

(Ozone Resistance Test)

The transfer roller manufactured according to each of Examples 1 to 7 and comparative examples 1 to 3 was dismantled, and the cylindrical roller body was opened into a flat plate and ozone-cured under the following conditions (corresponding to JIS K6259) in a state chucked on both ends and elongated to 50% in elongation percentage:

Ozone concentration: 50 pphm

Curing time: 24 hours

Environmental temperature: 40° C.

The cured roller body was visually observed, to evaluate ozone resistance according to the following criteria:

○: Unchanged. Excellently ozone-resistant.

Δ: Cracked at a microscopic level. Practically ozone-resistant.

x: Cracked at a visual level. Defectively ozone-resistant.

(Cost Evaluation)

The manufacturing cost for the transfer roller manufactured according to each of Examples 1 to 7 and comparative examples 1 to 3 with reference to the cost (100) required for manufacturing the transfer roller according to comparative example 1 was evaluated according to the following criteria:

○: Less than 75

Δ: not less than 75 and less than 90 x: not less than 90

Table 2 shows the results.

TABLE 2

| | | Ex. 1 | Ex. 2 | Ex. 3 | Ex. 4 | Ex. 5 | Ex. 6 | Ex. 7 | Comp. Ex. 1 | Comp. Ex. 2 | Comp. Ex. 3 |
|---|---|---|---|---|---|---|---|---|---|---|---|
| Part by Mass | SBR | 75 | 73 | 70 | 45 | 50 | 75 | 80 | — | 80 | 80 |
| | NBR | — | — | — | — | 20 | — | — | 80 | — | — |
| | ECO | 20 | 20 | 20 | 20 | 20 | 15 | 10 | 20 | 20 | — |
| | EPDM | 5 | 7 | 10 | 35 | 10 | 10 | 10 | — | — | 20 |
| | Filler | 10 | 10 | 10 | 10 | 10 | 10 | 10 | 10 | 10 | 10 |
| | Foaming Agent | 4 | 4 | 4 | 4 | 4 | 4 | 4 | 4 | 4 | 4 |
| | Foaming Assistant | 2.5 | 2.5 | 2.5 | 2.5 | 2.5 | 2.5 | 2.5 | 2.5 | 2.5 | 2.5 |
| | Acid Acceptor | 3 | 3 | 3 | 3 | 3 | 3 | 3 | 3 | 3 | 3 |
| | Vulcanizing Agent | 1.5 | 1.5 | 1.5 | 1.5 | 1.5 | 1.5 | 1.5 | 1.5 | 1.5 | 1.5 |
| | Accelerator DM | 0.5 | 0.5 | 0.5 | 0.5 | 0.5 | 0.5 | 0.5 | 0.5 | 0.5 | 0.5 |
| | Accelerator TS | 0.5 | 0.5 | 0.5 | 0.5 | 0.5 | 0.5 | 0.5 | 0.5 | 0.5 | 0.5 |
| Evaluation | Roller Resistance logR | 7.4 | 7.43 | 7.5 | 7.9 | 7.6 | 8.54 | 9.56 | 8.47 | 8.0 | 12.0 |
| | Ozone Resistance | Δ | ○ | ○ | ○ | ○ | ○ | ○ | x | x | ○ |
| | Cost | Δ | Δ | Δ | Δ | Δ | ○ | ○ | x | Δ | ○ |

From the results of Examples 1 to 7 and comparative examples 1 to 3 shown in Table 2, it has been understood possible to manufacture a transfer roller excellent in semi-conductivity and ozone resistance at a lower cost by employing universally applicable SBR in place of NBR and combinedly employing ECO and EPDM.

While the present invention has been described in detail by way of the embodiments thereof, it should be understood that these embodiments are merely illustrative of the technical principles of the present invention but not limitative of the invention. The spirit and scope of the present invention are to be limited only by the appended claims.

This application corresponds to Japanese Patent Application No. 2010-258085 filed with the Japan Patent Office on Nov. 18, 2010, the disclosure of which is incorporated herein by reference.

What is claimed is:

1. A transfer member, employed for transferring toner in an image forming apparatus utilizing electrophotography, made of a rubber composition at least containing styrene-butadiene rubber, ethylene-propylene-diene rubber and epichlorohydrin rubber as rubber components, and the rubber components contain styrene-butadiene rubber as a main component, wherein a compounding ratio of the styrene-butadiene rubber is not less than 40 mass % and not more than 90 mass % of the total quantity of the rubber components, a compounding ratio of the ethylene-propylene-diene rubber is not less than 5 mass % and not more than 40 mass % of the total quantity of the rubber components, and a compounding ratio of the epichlorohydrin rubber is not less than 5 mass % and not more than 20 mass % of the total quantity of the rubber components.

2. The transfer member according to claim 1, wherein the rubber composition further contains a foaming agent, and the transfer member has a porous structure resulting from foaming of the foaming agent.

3. The transfer member according to claim 1, wherein the rubber composition contains the styrene-butadiene rubber (S), the ethylene-propylene-diene rubber (E) and the epichlorohydrin rubber (C) in a range satisfying the following formula (1) in mass ratio:

$$S+C>E \quad (1).$$

4. The transfer member according to claim 1, wherein the rubber composition contains only the styrene-butadiene rubber, the ethylene-propylene-diene rubber and the epichlorohydrin rubber as the rubber components.

5. The transfer member according to claim 1, including a cylindrical roller body entirely made of the rubber composition.

6. The transfer member according to claim 1, wherein the rubber composition further contains polar rubber (P) in a range satisfying the following formula (2) with respect to the styrene-butadiene rubber (S) in mass ratio:

$$S>P \quad (2)$$

as an additional rubber component.

7. The transfer member according to claim 6, wherein the polar rubber is at least one material selected from a group consisting of acrylonitrile-butadiene rubber, chloroprene rubber, butadiene rubber and acrylic rubber.

* * * * *